United States Patent [19]

Stafset

[11] Patent Number: 4,620,393

[45] Date of Patent: Nov. 4, 1986

[54] TURNABLE WINDOW ARRANGEMENT HAVING A STOP DEVICE FOR A PARTIALLY OPEN POSITION

[75] Inventor: Kåre Stafset, Spjelkavik, Norway

[73] Assignee: Kva-Spil Ltd., Spjelkavik, Norway

[21] Appl. No.: 452,070

[22] Filed: Dec. 22, 1982

[30] Foreign Application Priority Data

Jan. 11, 1982 [NO] Norway ..... 820055

[51] Int. Cl.[4] ..... E05C 17/00

[52] U.S. Cl. ..... 49/394; 49/90; 292/263; 292/120

[58] Field of Search ..... 16/343, 345, 348, 360, 16/370, 371; 292/DIG. 20, 263, 109, 110, 114, 116, 120, 136; 49/90, 371, 391, 394

[56] References Cited

U.S. PATENT DOCUMENTS

| | | | |
|---|---|---|---|
| 2,661,506 | 12/1953 | Tracy | 49/90 X |
| 2,783,071 | 2/1957 | Williams | 49/394 X |
| 2,893,728 | 7/1959 | Tucker | 49/90 X |
| 2,967,334 | 1/1961 | Abelson | 49/90 X |
| 2,997,754 | 8/1961 | Walden | 49/394 X |
| 3,030,671 | 4/1962 | Jones | 49/90 X |
| 3,305,971 | 2/1967 | Golen | 49/394 X |
| 3,444,648 | 5/1969 | Anderson et al. | 49/394 X |
| 3,987,586 | 10/1976 | Rifkin | 49/394 |
| 4,080,758 | 3/1978 | Hubbard | 49/394 X |
| 4,232,890 | 11/1980 | Hoen | 292/114 |

FOREIGN PATENT DOCUMENTS

| | | | |
|---|---|---|---|
| 481714 | 3/1952 | Canada | 16/371 |
| 122614 | 10/1971 | Norway . | |

*Primary Examiner*—Donald R. Schran
*Assistant Examiner*—James L. Wolfe
*Attorney, Agent, or Firm*—Kenyon & Kenyon

[57] ABSTRACT

The manually releasable stop device permits unimpeded swinging of the window within a limited angle of rotation between the closed and partially open window. After releasing the stop device further swinging of the window is permitted beyond the limited angle of rotation. The stop device comprises two cooperating stop members (25, 26) which are fastened to respective support members (14, 18) in the window hinge which are pivotable relative to each other. A first stop member is constituted by a stop element (26) fixedly fastened to the one support member (14), and the second stop member is constituted by a self-locking catch element (25) fastened to the other support member (18). The catch element cooperates with a positive control mechanism (26, 32, 37, 39) in the pivotal region of the window within the limited angle of rotation. In the pivotal region the positive control mechanism is adapted to forcibly control the catch element (25) to engage with the fixedly fastened locking element (26), while the catch element in the pivotal region is designed for limited movement of the catch element relative to the fixed locking element.

10 Claims, 11 Drawing Figures

Figures 5, 6, 7, 8:
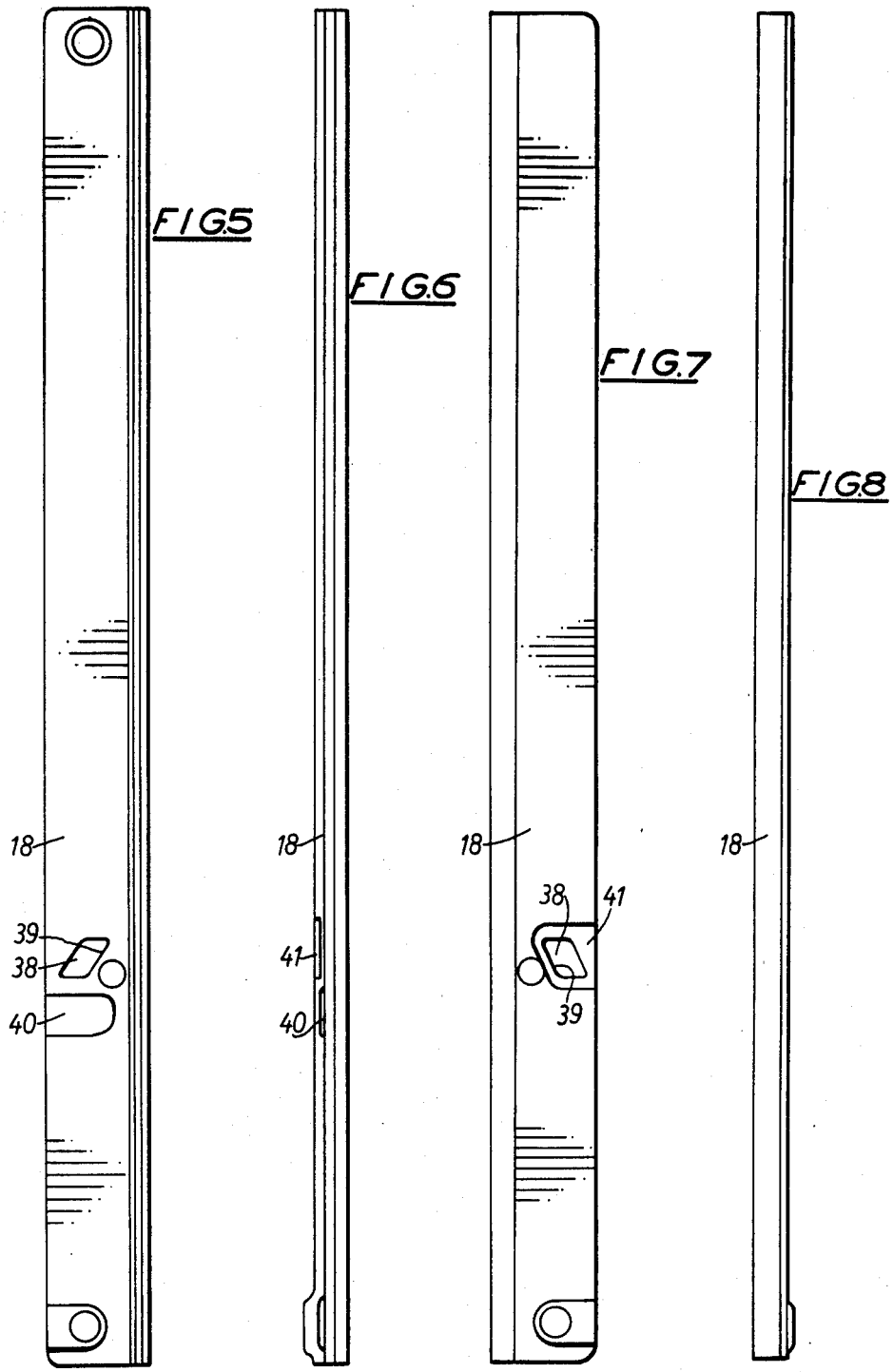

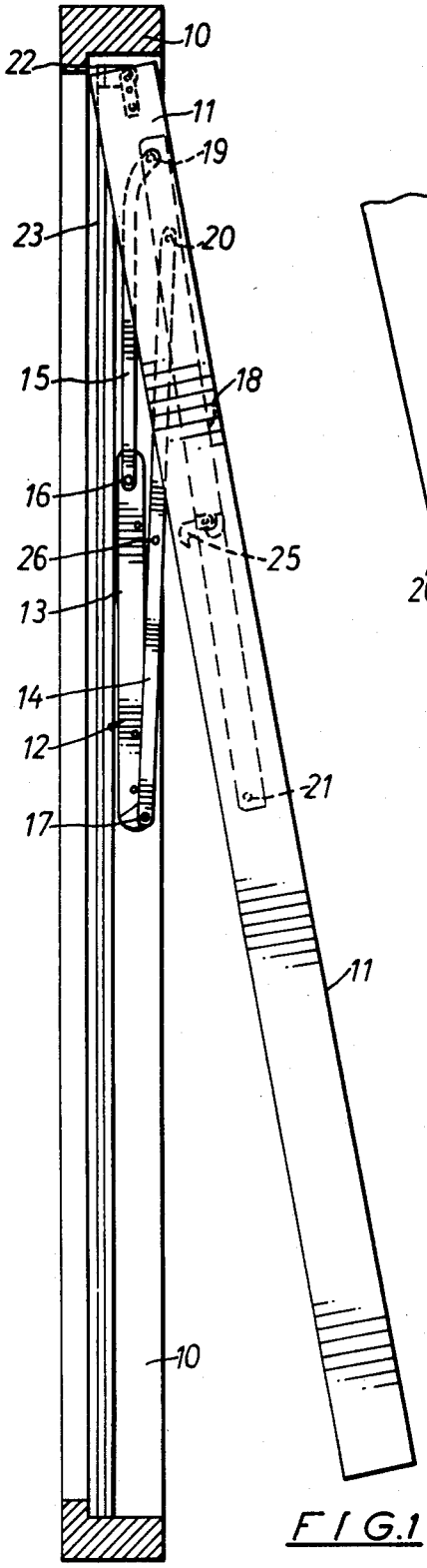
FIG.1
FIG.2
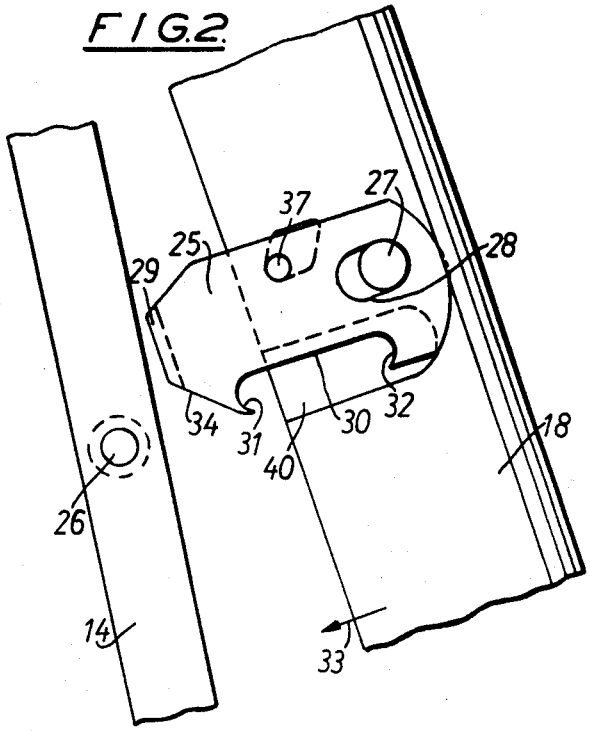
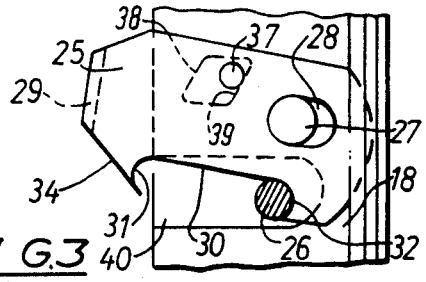
FIG.3
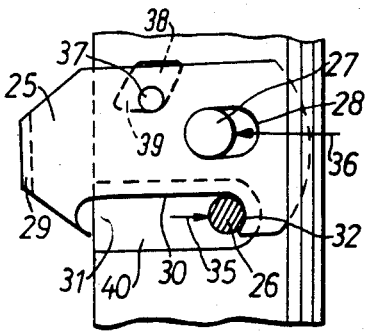
FIG.4

18
39
38
40
41

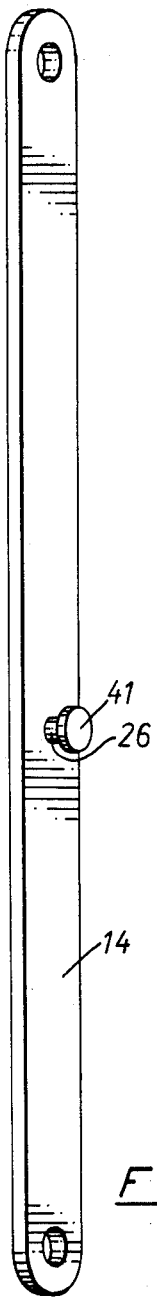
FIG.9
FIG.10
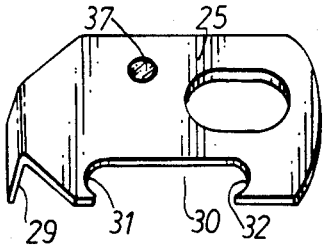
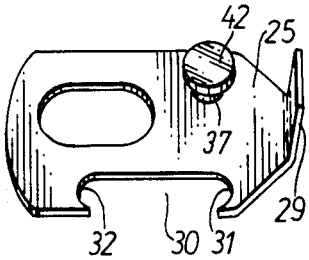
FIG.11

TURNABLE WINDOW ARRANGEMENT HAVING A STOP DEVICE FOR A PARTIALLY OPEN POSITION

This invention relates to turnable window arrangements having a hinge comprising two support members pivotable relative to each other and a manually releasable stop device having a locking element fixedly mounted on one of the support members and a self-locking catch element mounted on the other support member.

The stop devices have as a main purpose the permitting of unimpeded swinging of a window between a closed and a partially open position, that is the so-called airing position. The stop device has in such an airing position partly the function of a "casement stay" and partly the function of a "child safeguard" and is to ensure that the window in the airing position is not swung unintentionally outwards beyond a limited swinging possibility within its limited angle of rotation.

Norwegian Patent Specification No. 122,614, describes a stop device in the form of a vertically displaceable drop catch, which is displaceably mounted on the fastening member of a hinge and which has a lower hook member which cooperates with a corresponding upwardly directed hook member fixed to a pivot arm of the window hinge. The known drop catch is dependent upon the force of gravity for falling into place in the locking position. If the drop catch does not fall for one or another reason into position in the intended manner by means of the force of gravity, for example as a result of the formation of ice or as a consequence of other obstacles which occur, the stop device has no effect.

With the present invention the aim is a stop device which can be brought into place in the locking position without being dependent upon the effect of the force of gravity. In other words the force of gravity can be used if desired to bring the catch element into place in the locking position, but in all instances there are additional means to ensure the positioning of the catch element in the locking position, if the force of gravity is not sufficient. Alternatively, one can make oneself wholly independent of the effect of the force of gravity in order to bring the catch element into place in the locking position, by exclusively employing said extra means.

Accordingly, the present invention resides in a turnable window arrangement having a hinge comprising two support members pivotable relative to each other and a manually releasable stop device having a locking element fixedly mounted on one of the support members and a self-locking catch element mounted on the other support member. The locking member and the catch element are adapted to cooperate to permit unimpeded swinging of the window within a limited angle of rotation between closed and partially open positions of the latter while on release permitting the window to swing beyond the angle of rotation. The device incorporates a positive guide mechanism which when the window is within its limited angle of rotation forcibly guides the catch element into engagement with the locking element while permitting limited movement of the catch element relative to the locking element.

There is obtained, for example after the stop device has been released and the window has been pivoted beyond the limited angle of rotation and the window is again swung inwardly within the limited angle of rotation, the bringing of the catch element into a positive, forcibly controlled engagement with the locking element, that is to say with the catch element arranged in a forcibly controlled locking position.

In order that the invention can be more clearly understood, a convenient embodiment thereof will now be described, by way of example, with reference to the accompanying drawings in which:

FIG. 1 is a side, sectional view of a turnable window illustrated in a partially open position (airing position), FIG. 2 is an enlarged fragmentary view of a section of the stop device after it has been released, FIG. 3 is an enlarged fragmentary view of a section of the stop device with the associated positive control mechanism, immediately before the readjustment of the catch element to the locking position, FIG. 4 is a fragmentary view similar to FIG. 3 showing the catch element in the locking position, FIGS. 5–8 are views showing details of the one pivot arm which supports the catch element, FIG. 9 is a perspective view of the other pivot arm which supports the locking element, and FIGS. 10 and 11 are perspective views showing opposite sides of the catch element.

Referring to FIG. 1, there is shown a window frame 10 and a window casement 11, both made of wood in the usual manner. There is illustrated in FIG. 1, the one of two opposite window hinges 12 which consist of a fastening member 13 which is to be secured to the window frame 10, a first lower pivot arm or member 14 and a second upper pivot arm 15 which are linked to the fastening member 13 via their respective link pins 16 and 17 together with a third pivot arm or member 18 which is linked to the outer ends of the pivot arms 14, 15 via respective link pins 19 and 20. The pivot arm 14 and pivot arm 18 are thus pivotally mounted about a common pivot axis defined by the pin 20 while the pivot arms 15, 18 are pivotally mounted about a common pivot axis defined by the pin 19. The pivot arm 18 is linked at the opposite end around a link pin 21 to the mid-portion of the window casement 11. At 22, there is shown the one of two guide shoes which are pivotably mounted on opposite sides of the window casement at the normally upper edge of the window casement. The guide shoe is slidably mounted in a groove 23 which runs in the height dimension of the frame. On pivoting of the arms 14, 15 about the link pins 16, 17 of the fastening member 13, and on pivoting of the arm 18 correspondingly about link pins 19, 20 of the arms 14, 15, the window casement can be swung in a conventionally known manner about 180°, while the guide shoe 22 is displaced from the upper to the lower end of the groove 23. This swing movement can be controlled by exerting a pushing force against lower and upper edge portions of the window casement respectively.

A stop device is disposed in the hinge in a particularly easily accessible manner. In this arrangement, the stop device is provided with a catch element 25 fastened to the pivot arm 18 and a locking element 26 fastened to the pivot arm 14.

The catch element 25 is shown pivotably mounted on the pivot arm 18, at one end portion of the catch device. A pivot pin 27 is fastened to the pivot arm 18, and the catch element is provided with an elongate groove 28 which forms a pivot bearing of the catch element on the pivot pin 27 so that the catch element can be axially displaced a certain distance relative to the pivot pin 27. A catch-actuating means 29 is provided at the end of the catch to element 25 which lies opposite the groove 28.

This catch-actuating means 29 is in the form of a right angularly angled lug which can be operated by the finger of the user in order to raise the catch element 25 out of its locking engagement with the locking element 26. On the under side of the catch element, there is formed a groove 30 having hook-shaped end portions 31, 32. The catch element in the locking position extends substantially horizontally with the locking element 26 displaceably received in the groove 30 between end portions 31, 32 which form the limits for the mutual displacement between the catch element and the locking element. In addition, the catch element can be displaced a distance relative to the pivot pin 27 on the pivot arm 18 by means of the elongate swivel bearing-forming groove 28. The mutual pivoting between the pivot arms 18 and 14 in the locking position of the catch element is consequently partly limited by the length dimension of the groove 30 and partly limited by the length dimension of the groove 28. The elongated grooves 28, 30 and the catch element 25 thus form a positive guide mechanism to forcibly guide the catch element 25 into engagement with the locking element 26 while permitting limited movement of the catch element 25 relative to the locking element 26.

In FIG. 2, there are shown the arms 14 and 18 and the fastening member 13 after the stop device is released, that is to say after the lock catch is swung out of locking engagement and the window casement is thereafter swung somewhat outwards from the angle of rotation which is limited by the dimensions of length of the grooves 28, 30. The catch element 25 is pivoted, by means of the force of gravity, in place in the locking position. If the window is closed again once more, that is to say the pivot arm 18 is swung inwardly in the direction of the arrow 33, the locking element 26 on the arm 14 pushes first against a guide surface 34 on the catch element 25 directed obliquely downwards, just below the actuating means 29 so that the catch element 25 can be pivoted upwards and slip past the locking element 26.

In FIG. 3, there is shown the catch element 25 in such an upwardly swung position after the locking element 26 has taken up a position just by the inner end portion 32 of the groove 30.

In FIG. 4, there is shown the catch element 25 after the locking element 26 has forcibly guided the catch element 25 into place in the downwardly pivoted position, that is to say after the locking element 26 is pushed inwards, as is shown by the arrow 35, and the pivot pin 27 is displaced in the opposite direction in the groove 28, as is shown by the arrow 36.

By means of the positive control which is achieved between the pivot pin 27 and the groove 28 by means of guiding the locking element 26 against end portion 32 of the catch element in the groove 30, the positive pivoting of the catch element into place in the locking position can be ensured.

In order to ensure a controlled pivoting of the catch element 25 on the pivot arm 18, a guide pin 37 projects from the catch element 25 inwardly into a guide groove 38 in the pivot arm 18. An obliquely extending cam portion 39 in the guide groove 38 ensures an intentionally accurate forced control of the catch element 25 towards its locking position, while the guide groove 38 permits, besides, free axial displacement of the catch element in accordance with the length dimension of the groove 28 together with a limited pivotal movement about the pivot pin 27, in order to pivot the catch element out of locking engagement and back into locking engagement respectively.

In FIGS. 5–8, the pivot arm 18 is shown from different sides. At 40 there is shown a cavity for head portion **26*a* of locking member 26 (see also FIG. 3). At 41 there is also shown a cavity for head portion 42 of guide pin 37 together with groove 38 with cam surface 39 for the stem portion of guide pin 37 (the groove 38 with the cam surface 39 is shown in broken lines in FIGS. 2–4**).

From FIGS. 2–4, it is evident that the catch element 25 can be moved in a controlled manner with displacement and pivoting about the pin 27 guided by the groove 28 in the catch element 25 and with simultaneous movement of the pin 37 in the groove 38. When the catch element 25 is actuated by the guide pin 26 during closing of the window (see FIG. 3), the groove 28 and the cam surface 39 of the groove 38 ensure that the catch element is pivoted in a forcible manner about the pins 27 and 37 from the position shown in FIG. 3 to the position shown in FIG. 4.

The stop device is fastened with one member to the pivot arm 18 and a second member to the pivot arm 14, that is to say with the catch element 25 fastened to the pivot arm 18 and with the locking element fastened to the pivot arm 14. It is apparent that the locking element 26 can alternatively be fastened to the pivot arm 18 and the catch element 25 to the pivot arm 14. It will also be possible to fasten the stop device in another manner, for example, as is shown in Norwegian Patent Specification No. 122,614, with the one member fastened to the pivot arm and with the other member fastened to the fastening member of the hinge. With respect to the easy access to the actuating means 29 of the stop device, it is preferred, however, that the catch element is fastened to the one pivot arm while the locking element is fastened to the other pivot arm, as is shown in the accompanying drawing.

In the illustrated embodiment, the catch element is shown fastened in an approximately horizontal (locking) position but this is done in order to obtain a certain locking effect in the locking position of the locking catch by means of the force of gravity effect of the catch element. This force of gravity effect comes, as mentioned, in addition to the special positive control between locking element and catch element. Such a positive control can also be employed in such constructions where the force of gravity effect is without particular practical significance.

I claim:

1. Turnable window arrangement having a hinge for mounting a window on a frame, said hinge comprising two support members pivotable relative to each other about a common pivot axis and a manually releasable stop device having a locking element fixedly mounted on one of the support members and a self-locking catch element pivotally mounted on the other support member with a support means at one end for actuating said catch element, said locking member and said catch element being releasably engaged to permit unimpeded swinging of a window within a limited angle of rotation between closed and partially open positions of the window while on release permitting the window to swing beyond said angle of rotation about said pivot axis, said device incorporating a positive guide mechanism which when the window is within said limited angle of rotation forcibly guides said element into engagement with said locking element while permitting limited movement of said catch element relative to said locking element, said positive guide mechanism including guide members one of which is on said catch element while the other is formed by said locking element, said guide member on said catch element. being formed by an inner stop-forming end portion defining one end of a first guide groove in said catch element and said locking element being displaceable to a limited extent along said guide groove when said catch element is in said locking position.

2. The window arrangement of claim 1, wherein said catch element is axially movable relative to said other support member to a limited extent depending upon the length of a guide groove formed in said other support member and a guide pin engaging said groove and fixed to said catch element.

3. The window arrangement of claim 2, wherein said catch element is axially movable relative to said other support member to a limited extent depending upon the length of a second guide groove formed in said catch element and a guide pin engaging said groove and fixed to said support member.

4. In a turnable window arrangement, the combination comprising a hinge having a pair of support members disposed in pivotal relation to each other about a common pivot axis, and a manually releasable stop device for said hinge, said stop device including a locking element fixedly mounted on one of said members, a self-locking catch element pivotally mounted on the other of said members in releasable locking engagement with said locking element, and a positive guide mechanism forcibly guiding said catch element into engagement with said locking element while permitting limited movement of said catch element relative to said locking element to permit unimpeded swinging of said support members within a limited angle of rotation between closed and partially opened positions of the window and, on release, permitting said support members to swing beyond said angle of rotation about said pivot axis.

5. The combination as set forth in claim 4 wherein said other member includes a pivot pin pivotally mounting said catch element thereon and wherein said positive guide mechanism includes a first elongated groove in said catch element for receiving said locking element and a second elongated groove in said catch element for receiving said pivot pin.

6. The combination as set forth in claim 5 wherein said catch element is longitudinally movable relative to said pivot pin.

7. The combination as set forth in claim 5 which further comprises a pin on said catch element and a guide groove in said other member having a cam portion receiving said pin on said catch element to force said catch element to forcibly engage said locking element during engagement of said catch element with said locking element.

8. In a turnable window arrangement, the combination comprising a hinge having a pair of support members disposed in pivotal relation to each other about a common pivot axis; and a manually releasable stop device for said hinge, said stop device including a locking element fixedly mounted on one of said members, a pivot pin mounted on the other of said members, a self-locking catch element pivotally mounted on said pivot pin for locking engagement with said locking element, said catch element having an elongated groove receiving said pivot pin and a second elongated groove for receiving said locking element, and a positive guide mechanism to forcibly guide said catch element into engagement with said locking element while permitting limited movement of said locking element within said second groove to allow said catch element to move relative to said locking element.

9. A turnable window comprising a window frame;

a window casement;

a pair of hinges for pivoting said casement relative to said frame between a closed position and an open position; each said hinge including a pair of support members disposed in pivotal relation to each other, a first of said members being pivotally mounted at one end on said frame and a second of said members being pivotally mounted at one end on said casement; and a stop device for locking said casement in a partially-opened position between said closed position and said open position, said device including a locking element on one of said members, a pivot pin mounted on said other member, a catch element pivotally mounted on said pivot pin and having a first elongated groove receiving said pivot pin and a second elongated groove for receiving said locking element in said partially-open position of said casement to permit limited movement of said casement relative to said frame.

10. A turnable window as set forth in claim 9 wherein each hinge includes a third member pivotally mounted at one end on said frame and at an opposite end on said second member.

* * * * *